US011432075B2

(12) United States Patent
Peterson et al.

(10) Patent No.: US 11,432,075 B2
(45) Date of Patent: Aug. 30, 2022

(54) SELECTING AUDIO INPUT

(71) Applicant: LENOVO (Singapore) PTE. LTD., New Tech Park (SG)

(72) Inventors: Nathan J. Peterson, Oxford, NC (US); Mark Patrick Delaney, Raleigh, NC (US); John Carl Mese, Cary, NC (US); Russell Speight VanBlon, Raleigh, NC (US); Arnold S. Weksler, Raleigh, NC (US)

(73) Assignee: Lenovo (Singapore) PTE. LTD., New Tech Park (SG)

( * ) Notice: Subject to any disclaimer, the term of this patent is extended or adjusted under 35 U.S.C. 154(b) by 207 days.

(21) Appl. No.: 16/836,177

(22) Filed: Mar. 31, 2020

(65) Prior Publication Data

US 2021/0306766 A1 Sep. 30, 2021

(51) Int. Cl.
*H04R 25/00* (2006.01)
*H04R 3/00* (2006.01)

(52) U.S. Cl.
CPC ..... *H04R 25/407* (2013.01); *H04R 3/00* (2013.01)

(58) Field of Classification Search
CPC ..... H04R 25/407; H04R 3/00
See application file for complete search history.

(56) References Cited

U.S. PATENT DOCUMENTS

2017/0332168 A1* 11/2017 Moghimi ..... G10L 21/0208
2020/0175969 A1* 6/2020 Aleksic ..... G10L 15/1815

* cited by examiner

*Primary Examiner* — Andrew L Sniezek
(74) *Attorney, Agent, or Firm* — Kunzler Bean & Adamson

(57) ABSTRACT

For selecting audio input, a processor calculates audio scores for device audio from a plurality of electronic devices. The processor further selects a first device audio based on the audio scores. The processor presents present the first device audio at a listening electronic device.

17 Claims, 5 Drawing Sheets

SELECTING AUDIO INPUT

FIELD

The subject matter disclosed herein relates to selecting audio input and more particularly relates to selecting audio input from a plurality of electronic devices.

BACKGROUND

Listening electronic devices such as hearing aids amplify audio inputs for a user.

BRIEF SUMMARY

An apparatus for selecting audio input is disclosed. The apparatus includes a processor and a memory that stores code executable by the processor. The processor calculates audio scores for device audio from a plurality of electronic devices. The processor further selects a first device audio based on the audio scores. The processor presents present the first device audio at a listening electronic device. A method and program product also perform the functions of the apparatus.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1A:
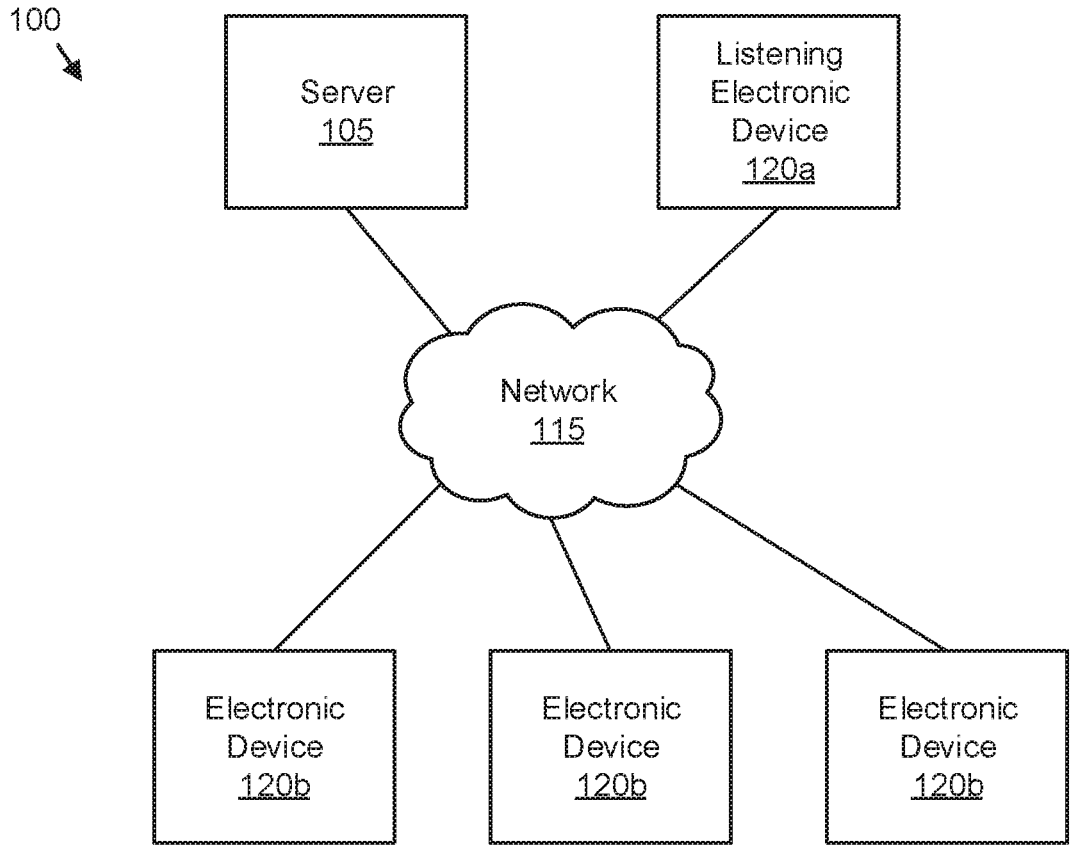
FIG. 1A is a schematic block diagram illustrating one embodiment of an audio system.

As will be appreciated by one skilled in the art, aspects of the embodiments may be embodied as a system, method or program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a program product embodied in one or more computer readable storage devices storing machine readable code, computer readable code, and/or program code, referred hereafter as code. The storage devices may be tangible, non-transitory, and/or non-transmission. The storage devices may not embody signals. In a certain embodiment, the storage devices only employ signals for accessing code.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules and may be embodied in any suitable form and organized within any suitable type of data structure. The operational data may be collected as a single data set or may be distributed over different locations including over different computer readable storage devices. Where a module or portions of a module are implemented in software, the software portions are stored on one or more computer readable storage devices.

Any combination of one or more computer readable medium may be utilized. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

Code for carrying out operations for embodiments may be written in any combination of one or more programming languages including an object oriented programming language such as Python, Ruby, R, Java, Java Script, Smalltalk, C++, C sharp, Lisp, Clojure, PHP, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise. The term "and/or" indicates embodiments of one or more of the listed elements, with "A and/or B" indicating embodiments of element A alone, element B alone, or elements A and B taken together.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and program products according to embodiments. It will be understood that each block of the schematic flowchart diagrams and/or schematic block diagrams, and combinations of blocks in the schematic flowchart diagrams and/or schematic block diagrams, can be implemented by code. This code may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The code may also be stored in a storage device that can direct a computer, other programmable data processing apparatus, or other devices to function in a particular manner, such that the instructions stored in the storage device produce an article of manufacture including instructions which implement the function/act specified in the schematic flowchart diagrams and/or schematic block diagrams block or blocks.

The code may also be loaded onto a computer, other programmable data processing apparatus, or other devices to cause a series of operational steps to be performed on the computer, other programmable apparatus or other devices to produce a computer implemented process such that the code which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and program products according to various embodiments. In this regard, each block in the schematic flowchart diagrams and/or schematic block diagrams may represent a module, segment, or portion of code, which comprises one or more executable instructions of the code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and code.

The description of elements in each figure may refer to elements of proceeding figures. Like numbers refer to like elements in all figures, including alternate embodiments of like elements.

FIG. 1A is a schematic block diagram illustrating one embodiment of an audio system 100. The audio system 100 provides device audio to a listening electronic device 120*a*. As used herein, device audio is audio received at a microphone. In the depicted embodiment, the audio system 100 includes a server 105, the listening electronic device 120*a*, a network 115, and a plurality of electronic devices 120*b*.

The listening electronic device 120*a* may provide device audio for a user. The listening electronic device 120*a* may be a hearing aid. In addition, the listening electronic device 120*a* may be headphones, discrete speakers, and the like. In one embodiment, the user relies on the listening electronic device 120*a* to hear audio communications in the environment. The listening electronic device 120*a* may be capable of amplifying and/or processing audio in the environment for the user.

Unfortunately, the device audio that is amplified and/or processed by the listening electronic device 120*a* may have a reduced clarity and/or volume. For example, the clarity of the audio that is received by the listening electronic device 120*a* may be reduced by noise between the source of the audio and the listening electronic device 120*a* and/or noise in the environment. In addition, the volume of the audio that is received by the listening device 120*a* may be reduced by the distance between the source of the audio and the listening electronic device 120*a*. As a result, the device audio that is amplified and processed by the listening electronic device 120*a* for the user has reduced quality.

The embodiments improve the quality of the device audio presented to the user by the listening electronic device 120*a* by selecting at least one of the plurality of electronic devices 120 to provide the device audio for the listening electronic device 120*a*. The device audio is selected based on audio scores calculated for the device audio from the plurality of electronic devices 120. The selected device audio is presented at the listening electronic device 120*a*. As a result, the device audio with the best quality is presented at the listening electronic device 120*a*, improving the efficiency of the listening electronic device 120*a* as will be described hereafter.

In one embodiment, the server 105 and/or listening electronic device 120*a* discover the electronic devices 120*b* that are in the environment. The server 105 and/or the listening electronic device 120*a* may discover the electronic devices 120*b* by communicating with the electronic devices 120*b* through the network 115. The server 105, the listening electronic device 120*a*, and the electronic devices 120*b* may each communicate with the network 115. The network 115 may include a BLUETOOTH® connection, the Internet, a local area network, a mobile telephone network, a Wi-Fi network, a wide-area network, or combinations thereof.

The server 105 and/or the listening electronic device 120*a* may connect with each electronic device 120*b* that is discovered and receive device audio from the electronic devices 120*b*. The server 105 and/or the listening electronic device 120*a* may further calculate an audio score for each electronic device 120*b* and select a first device audio based on the audio scores. The server 105 and/or the listening electronic device 120*a* may present the first device audio at the listening electronic device 120*a*. In a certain embodiment, the server 105 processes the first device audio for the listening electronic device 120*a*. In addition, the listening electronic device 120*a* may process the first device audio. Because the first device audio has superior quality, the listening experience of the user of the listening electronic device 120*a* is improved. In addition, the function of the listening electronic device 120*a* is also improved.

Figure 1B:
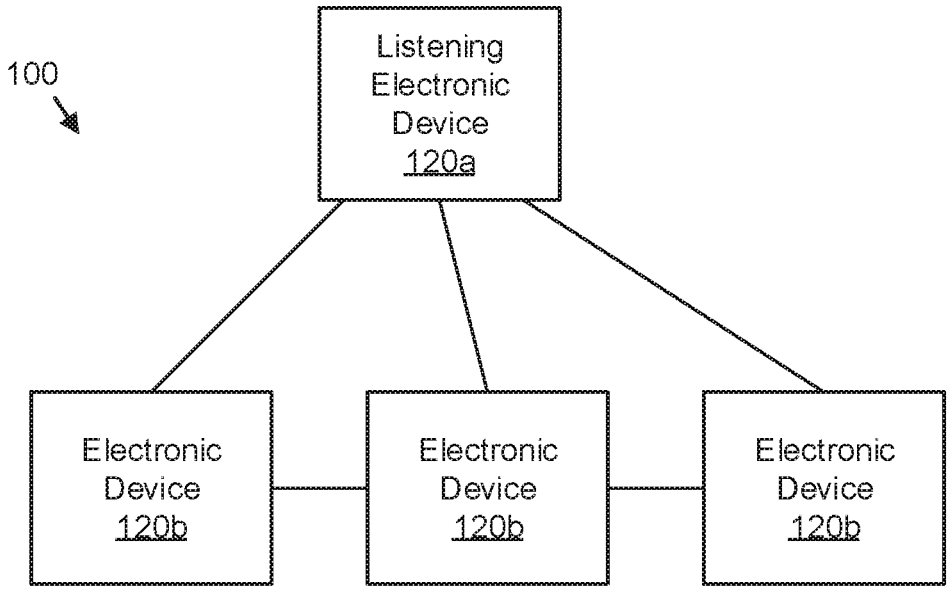
FIG. 1B is a schematic block diagram illustrating one alternate embodiment of an audio system.

FIG. 1B is a schematic block diagram illustrating one alternate embodiment of an audio system 100. The audio system 100 provides audio input to the listening electronic device 120*a*. In the depicted embodiment, the audio system 100 includes the listening electronic device 120*a* and a plurality of electronic devices 120*b*. The listening electronic device 120*a* may communicate with the electronic devices 120*b* through a direct connection such as a BLUETOOTH® connection. In addition, an electronic device 120*b* may communicate with another electronic device 120*b*.

The listening electronic device 120*a* may discover the electronic devices 120*b* that are in the environment. The listening electronic device 120*a* may discover the electronic devices 120*b* by communicating with the electronic devices 120*b* through the direct connection.

The listening electronic device 120*a* may connect with each electronic device 120*b* that is discovered and receive device audio from the electronic devices 120*b*. The listening electronic device 120*a* may further calculate an audio score for each electronic device 120*b* and select a first device audio based on the audio scores. In addition, each electronic device 120*b* may calculate the audio score for the electronic device's own device audio and/or for other electronic devices 120. The listening electronic device 120*a* and/or the plurality of electronic devices 120*b* may select the first audio input of a first electronic device 120*a/b*. The selected first electronic device 120*a/b* may present the first device audio at the listening electronic device 120*a*. Because the first device audio has superior quality, the listening experience of the user of the listening electronic device 120*a* is improved. In addition, the function of the listening electronic device 120*a* is also improved.

Figure 2:
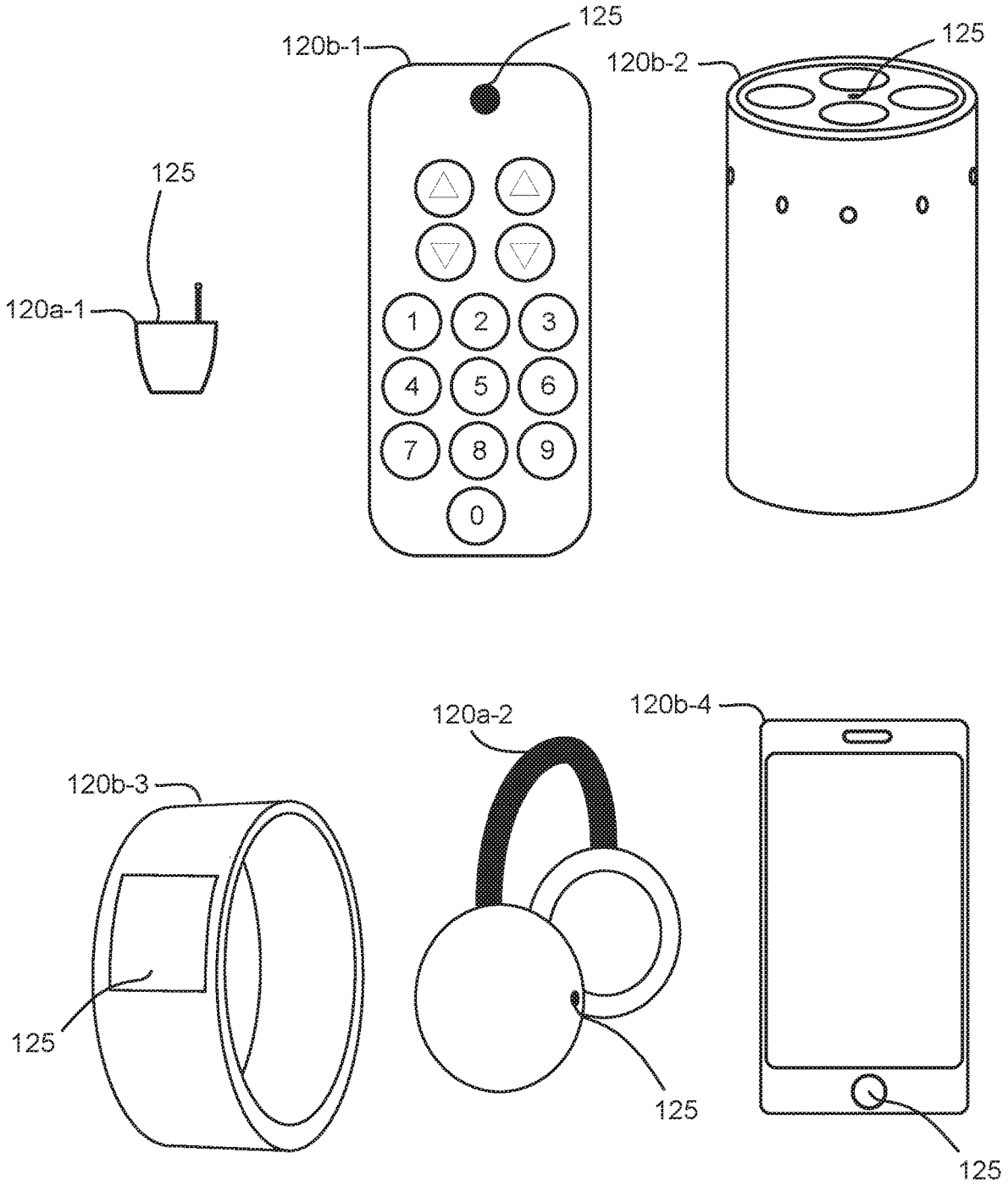
FIG. 2 are drawings illustrating embodiments of electronic devices.

FIG. 2 are drawings illustrating embodiments of electronic devices 120. The electronic devices 120 include listening electronic devices 120*a* such as a hearing aid 120*a*-1 and headphones 120*a*-2. In addition, the electronic devices 120 include a remote electronic device 120*b*-1, an electronic appliance electronic device 120*b*-2, a wearable electronic device 120*b*-3, and a mobile telephone electronic device 120*b*-4. Each electronic device 120 includes a microphone 125 to capture device audio.

Figure 3A:
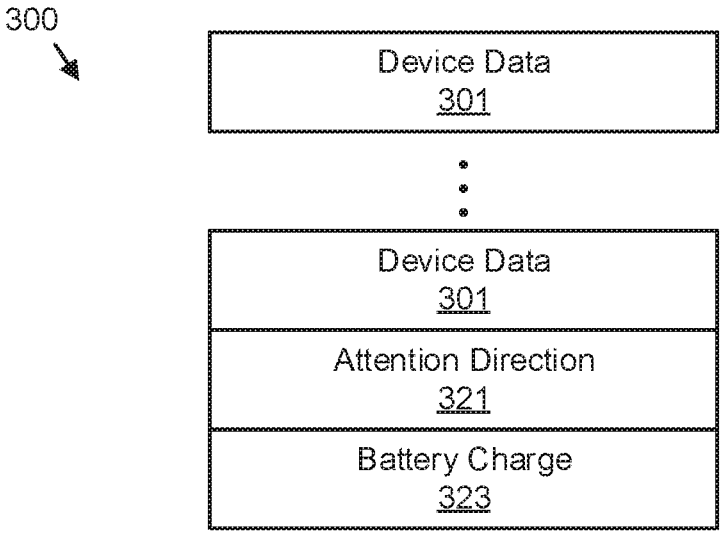
FIG. 3A is a schematic block diagram illustrating one embodiment of audio data.

FIG. 3A is a schematic block diagram illustrating one embodiment of audio data 300. The audio data 300 is used to calculate the audio scores and select the device audio for presentation to the listening electronic device 120*a*. The audio data 300 may be organized as a data structure in a memory. The audio data 300 may reside on the server 105 and/or the listening electronic device 120*a*. In addition, the audio data 300 may be distributed among the electronic devices 120*b*. In the depicted embodiment, the audio data 300 includes a plurality of device data 301, an attention direction 321, and a battery charge 323.

The audio data 300 may include device data 301 for each electronic device 120 including the listening electronic device 120*a*. The device data 301 is described hereafter in FIG. 3B.

The attention direction 321 may record where the user of the listening electronic device 120*a* is listening. The attention direction 321 may indicate the direction of human speech relative to the listening electronic device 120*a*. For example, if one person is talking in the environment, the attention direction 321 may indicate the direction of the person.

In addition, the attention direction 321 may indicate the direction of the loudest audio relative to the listening electronic device 120*a*. For example, the attention direction 321 may indicate the direction of music or a television program in the environment.

In a certain embodiment, the attention direction 321 indicates the direction that the user of the listening electronic device 120*a* is looking. One or more electronic devices 120 may use the camera and eye tracking to determine the direction the user is looking.

The battery charge 323 may record the battery charge remaining for the listening electronic device 120*a*. The battery charge 323 may be used to calculate the audio score as will be described hereafter.

Figure 3B:
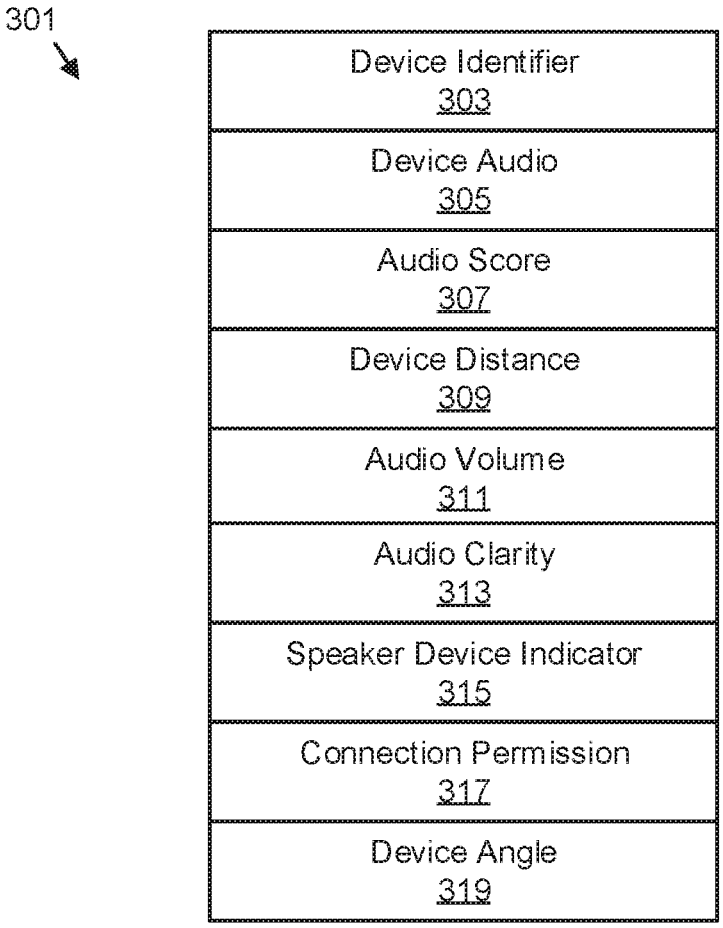
FIG. 3B is a schematic block diagram illustrating one embodiment of device data.

FIG. 3B is a schematic block diagram illustrating one embodiment of device data 301. The device data 301 may be organized as a data structure in a memory. In the depicted embodiment, the device data 301 includes a device identifier 303, the device audio 305, the audio score 307, a device distance 309, an audio volume 311, an audio clarity 313, a speaker device indicator 315, a connection permission 317, and a device angle 319.

The device identifier 303 may identify the electronic device 120 of the device data 301. The device audio 305 comprises the audio stream captured by the microphone 125 of the electronic device 120. The device distance 309 may record a distance from the electronic device 120 to the listening electronic device 120*a*. The device angle 319 may record an angular direction of the electronic device 120. In one embodiment, the device angle 319 records an angular difference between the angular direction of the electronic device 120 and the attention direction 321.

The audio volume 311 may record the average volume of the device audio 305 received at the electronic device 120. The audio volume may be measure in Deci-Bells (dB). The audio clarity 313 may record the clarity of the device audio 305 received at the electronic device 120. In one embodiment, the audio clarity 313 is a signal-to-noise ratio.

The speaker device indicator 315 is asserted if the electronic device 120 is the electronic device of a current speaker. For example, if the current speaker in the environment is in possession of a mobile telephone electronic device 120*b*-4, the speaker device indicator 315 may be asserted for the mobile telephone electronic device 120*b*-4.

The connection permission 317 is asserted if the device audio 305 of the electronic device 120 may be used by the listening electronic device 120*a*. For example, friends and/or family of the user of the listening electronic device 120*a* may assert the connection permission 317 to allow sharing of the device audio 305 with the listening electronic device 120*a*. In one embodiment, the plurality of electronic devices 120 comprises the electronic devices 120 that granted the connection permission 317.

The audio score 307 is calculated for the device audio 305. In one embodiment, each audio score 307 is based on the audio volume 311 and the audio clarity 313. For example, the audio score AS 307 for electronic device 120 may be calculated using Equation 1, wherein AV is the audio volume 311, AC is the audio clarity 313, and j and k are nonzero constants.

$$AS=j*AV+k*AC \quad \text{Equation 1}$$

In one embodiment, the audio score 307 is calculated based on the attention direction 321. For example, the audio score AS 307 may be calculated using Equation 2, wherein y is a difference between the attention direction 321 and the device angle 319, g is a Gaussian function, and l is a nonzero constant.

$$AS=l*g(y) \quad \text{Equation 2}$$

The audio score 307 may be calculated based on the device distance 309. In one embodiment, the y of Equation 2 is the device distance 309. In a certain embodiment, the y of Equation 2 is a location calculated from the device angle 319 and the device distance 309.

The audio score 307 may be based on the battery charge 323 of the listening electronic device 120. In one embodiment, the battery charge 323 modifies the audio score 307. For example, the audio score AS 307 may be modified as shown in Equation 3, M wherein AS' is the modified audio score 307 and BC is the battery charge 323.

$$AS'=AS*\sqrt{BC} \quad \text{Equation 3}$$

In one embodiment, the audio score 307 is based on an owner of the electronic device 120 speaking. The owner of the electronic device 120 speaking is indicated by the assertion of the speaker device indicator 315. For example, the audio score AS 307 may be calculated using Equation 4, wherein SDI is a binary value of the speaker device indicator 315 and n is a nonzero constant.

$$AS=n*SDI \quad \text{Equation 4}$$

In one embodiment, the audio score 307 is calculated as a weighted average of the audio scores 307 calculated using Equations 1, 2, and 4. In addition, the weighted average may be modified as shown in Equation 3. The weighted average may be calculated using Equation 5, wherein $w_i$ is a weight for the ith audio score $AS_i$ 307.

$$AS=\Sigma w_i AS_i \quad \text{Equation 5}$$

Figure 4:
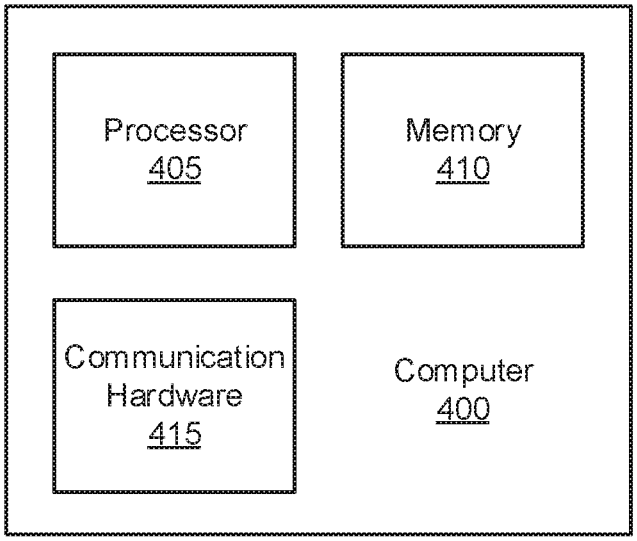
FIG. 4 is a schematic block diagram illustrating one embodiment of a computer.

FIG. 4 is a schematic block diagram illustrating one embodiment of a computer 400. The server 105, listening electronic device 120*a*, and/or electronic devices 120*b* may each comprise a computer 400. In the depicted embodiment, the computer 400 includes a processor 405, a memory 410, and communication hardware 415. The memory 410 may include a semiconductor storage device, a hard disk drive, an optical storage device, or combinations thereof. The memory 410 may store code. The processor 405 may execute the code. The communication hardware 415 may communicate with other devices such as through a BLUETOOTH® connection and/or an Internet connection.

Figure 5:
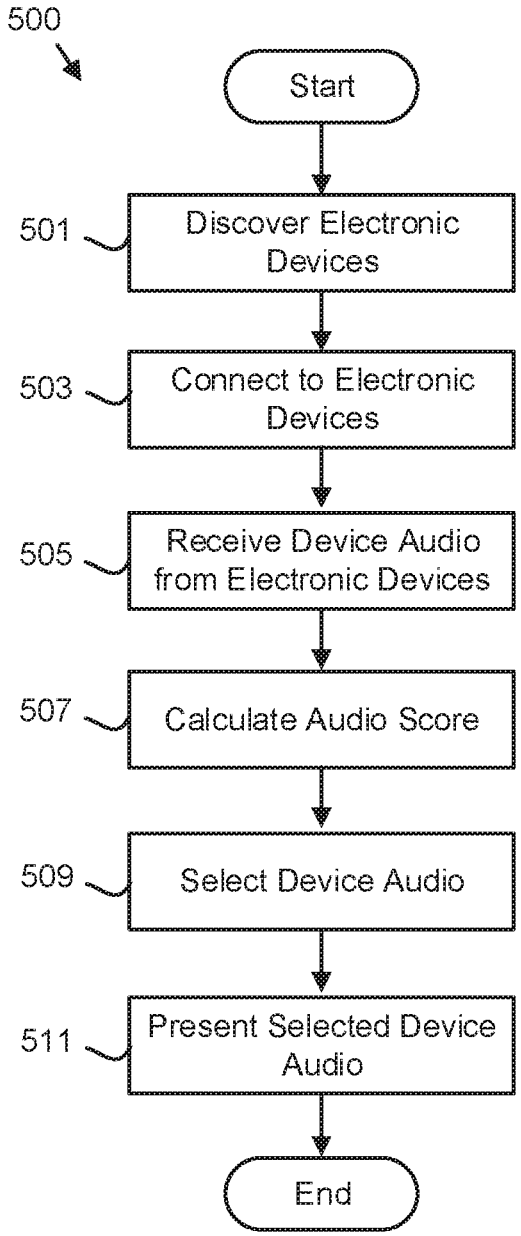
FIG. 5 is a schematic flow chart diagram illustrating one embodiment of an audio input selection method.

FIG. 5 is a schematic flow chart diagram illustrating one embodiment of an audio input selection method 500. The method 500 may select a first device audio 305 based on the audio scores 307 and present the first device audio 305 at the listening electronic device 120. The method 500 may be performed by the computers 400 and/or processor 405 of the server 105 and/or electronic devices 120.

The method 500 starts, and in one embodiment, the processor 405 discovers 501 the electronic devices 120. The processor 405 may discover 501 the electronic devices 120 in the environment. The plurality of electronic devices 120 may include the listening electronic device 120*a*.

In one embodiment, the processor 405 discovers 501 the electronic devices 120 via the network 115. In addition, the processor 405 may discover 501 the electronic devices 120 by requesting a pairing such as a BLUETOOTH® pairing. Each electronic device 120 that responds to the request may be discovered 501.

The processor 405 further connects 503 to the discovered electronic devices 120. The processor 405 may only connect 503 to electronic devices 120 that granted the connection permission 317. The connection 503 may be established via the network 115. In addition, the connection 503 may be established via a BLUETOOTH® connection.

In one embodiment, the processor 405 receives 505 the device audio 305 from the plurality of electronic devices 120. The plurality of electronic devices 120 may comprise the listening electronic device 120*a*. For example, the server 105 may receive the device audio 305 from the plurality of electronic devices 120. In addition, the listening electronic device 120*a* may receive the device audio 305 from the plurality of electronic devices 120. In a certain embodiment, a given electronic device 120*b* may receive the device audio 305 from the plurality of electronic devices 120.

The processor 405 may calculate 507 the audio score 307 for the device audio 305 from the plurality of electronic devices 120. In one embodiment, the server 105, listening electronic device 120*a*, and/or given electronic device 120*b* calculates 507 the audio score 307 for each electronic device 120. In addition, each electronic device 120 may calculate 507 the audio score 307 for the electronic device's own device audio 305.

The audio score 307 may be calculated 507 based on the audio volume 311 and the audio clarity 313. In addition, the audio score 307 may be calculated 507 based on the attention direction 321 of the listening electronic device user. In one embodiment, the audio score 307 is based on the battery charge 323 of the listening electronic device 120. In a certain embodiment, the audio score 307 is based on the owner of the electronic device 120 speaking.

The processor 405 may calculate 507 the audio score 307 for each electronic device 120 using at least one of Equations 1-5. The equations may be used singly and/or together to calculate 507 the audio score 307.

The processor 405 may select 509 a first device audio 305 based on the audio scores 307. A best audio score 307 may be selected 509. The best audio score 307 may be a highest audio score 307.

The processor 405 may further present 511 the selected first device audio 305 at the listening electronic device 120 and the method 500 ends. The processor 405 may present 511 the selected first device audio 305 by communicating the first device audio 305 via the network 115 and/or a connection. The listening electronic device 120 may further present the first device audio 305 to the user.

By selecting the first device audio 305 based on the audio scores 307, the embodiments select a best device audio 305 from a plurality of sources for the device audio 305 that is presented at the listening electronic device 120*a*. As a result, the user of a listening electronic device 120*a* such as a hearing aid electronic device 120*a*-1 is presented the device audio 305 from the electronic device 120 in the environment with the best device audio 305. For example, if a speaker in an environment is across the room from the listening electronic device 120*a*, the embodiments may recruit a mobile telephone electronic device 120*b*-4 and/or a nearby audio appliance electronic device 120*b*-2 to capture the device audio 305 with a microphone 125 and communicate the device audio 305 to the listening electronic device 120*a*. Because the device audio 305 is captured closer to the speaker, the audio quality of the device audio 305 is improved over what may be captured by the listening electronic device 120*a*. As a result, the efficiency and efficacy of the listening electronic device 120*a* and the computer 400 and/or processor 405 therein is improved.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a processor;

a memory that stores code executable by the processor to:

calculate audio scores for device audio from a plurality of electronic devices, wherein each audio score is calculated as Gaussian of a difference between an attention direction and a device angle, the attention direction indicates a direction of human speech relative to a listening electronic device and the device angle records an angular direction of an electronic device;

select a first device audio based on the audio scores; and present the first device audio at the listening electronic device.

2. The apparatus of claim 1, wherein the audio scores are further based on an audio volume and an audio clarity.

3. The apparatus of claim 1, wherein the audio scores are further based on a battery charge of the listening electronic device.

4. The apparatus of claim 1, wherein the audio scores are further based on an owner of an electronic device speaking.

5. The apparatus of claim 1, wherein the plurality of electronic devices comprises the listening electronic device.

6. The apparatus of claim 1, wherein the plurality of electronic devices comprises electronic devices that granted a connection permission.

7. A method comprising:

calculating, by use of a processor, audio scores for device audio from a plurality of electronic devices, wherein each audio score is calculated as Gaussian of a difference between an attention direction and a device angle, the attention direction indicates a direction of human speech relative to a listening electronic device and the device angle records an angular direction of an electronic device;

selecting a first device audio based on the audio scores; and presenting the first device audio at the listening electronic device.

8. The method of claim 7, wherein the audio scores are further based on an audio volume and an audio clarity.

9. The method of claim 7, wherein the audio scores are further based on a battery charge of the listening electronic device.

10. The method of claim 7, wherein the audio scores are further based on an owner of an electronic device speaking.

11. The method of claim 7, wherein the plurality of electronic devices comprises the listening electronic device.

12. The method of claim 7, wherein the plurality of electronic devices comprises electronic devices that granted a connection permission.

13. A program product comprising a non-transitory computer readable storage medium that stores code executable by a processor, the executable code comprising code to:

calculate audio scores for device audio from a plurality of electronic devices, wherein each audio score is calculated as Gaussian of a difference between an attention direction and a device angle, the attention direction indicates a direction of human speech relative to a listening electronic device and the device angle records an angular direction of an electronic device;

select a first device audio based on the audio scores; and present the first device audio at the listening electronic device.

14. The program product of claim 13, wherein the audio scores are further based on an audio volume and an audio clarity.

15. The program product of claim 13, wherein the audio scores are further based on a battery charge of the listening electronic device.

16. The program product of claim 13, wherein the audio scores are further based on an owner of an electronic device speaking.

17. The program product of claim 13, wherein the plurality of electronic devices comprises electronic devices that granted a connection permission.

* * * * *